US008919900B2

(12) United States Patent
Yamagata et al.

(10) Patent No.: US 8,919,900 B2
(45) Date of Patent: Dec. 30, 2014

(54) PRINTING APPARATUS

(71) Applicant: Seiko Epson Corporation, Tokyo (JP)

(72) Inventors: Shinya Yamagata, Nagano-ken (JP); Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 13/904,541

(22) Filed: May 29, 2013

(65) Prior Publication Data

US 2014/0354719 A1 Dec. 4, 2014

(51) Int. Cl.
*B41J 2/195* (2006.01)
*B41J 2/175* (2006.01)

(52) U.S. Cl.
CPC ..... *B41J 2/17566* (2013.01)
USPC ..... 347/7; 347/6; 347/19; 347/86

(58) Field of Classification Search
CPC ..... B41J 2/17566; B41J 2002/17566; B41J 2002/17569; B41J 2002/17573; B41J 2002/17576; B41J 2002/17579; B41J 2002/17583; B41J 2002/17586; B41J 2002/17589
See application file for complete search history.

(56) References Cited

U.S. PATENT DOCUMENTS

2010/0238208 A1 9/2010 Sakurai

FOREIGN PATENT DOCUMENTS

JP 2010-58305 A 3/2010
JP 2010-214759 A 9/2010

*Primary Examiner* — Justin Seo

(57) ABSTRACT

A printing apparatus includes a detection unit that detects the amount of residual ink in a ink cartridge, and a control unit that controls of initial filling of a printing head, in which the control unit performs initial filling when a state of the amount of residual ink detected by the detection unit is equal to or more than a predetermined amount, and the amount of residual ink based on information on the amount of ink stored in a storage unit is equal to or more than a predetermined value.

3 Claims, 8 Drawing Sheets

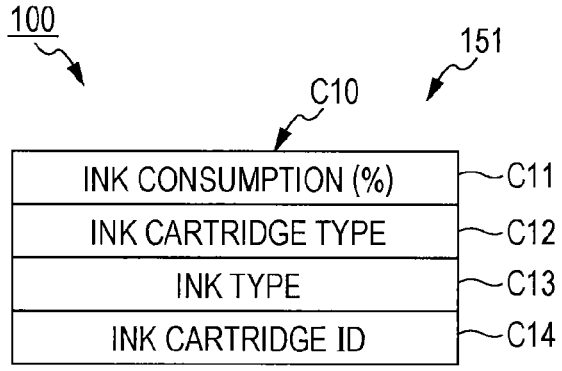
FIG. 4
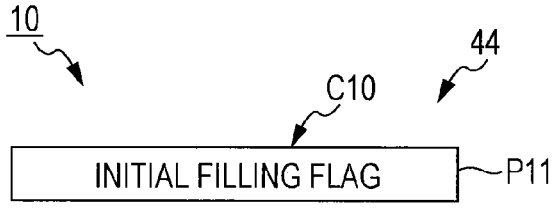
FIG. 5
EFFECTIVE AMOUNT OF INK (g)
| INK CARTRIDGE TYPE / INK TYPE | BUNDLE | L SIZE | M SIZE | S SIZE |
|---|---|---|---|---|
| BLACK | 12 | 11 | 8 | 5 |
| CYAN | 8 | 10 | 7 | 1 |
| MAGENTA | 8 | 10 | 7 | 1 |
| YELLOW | 8 | 10 | 7 | 1 |
FIG. 6

PRINTING APPARATUS

BACKGROUND

1. Technical Field

The present invention relates to a printing apparatus, in particular, to a printing apparatus performing an initial filling.

2. Background Art

A printing apparatus that discharges ink from a nozzle of a printing head is known. When such a printing apparatus is used for the first time after shipment, an initial filling process is performed in which the ink is filled in a series of flow paths (for example, supply tube and the like) for supplying the ink to the printing head from an ink supplying port of an ink cartridge. JP-A-2010-58305 discloses a technique that verifies whether an ink cartridge having an amount of ink required for initial filling is mounted in a printing apparatus when the initial filling process is performed.

In a case of the printing apparatus described in JP-A-2010-58305, it is determined whether or not an amount of ink with a condition required for the initial filling is satisfied on the basis of an ink consumption stored in a storage element of the ink cartridge. Therefore, when an amount of residual ink calculated on the basis of the ink consumption stored in the storage element and an actual amount of residual ink in the ink cartridge are different from each other, there is a possibility that problems may occur. For example, when the amount of ink with the condition required for the initial filling is satisfied for the calculated amount of residual ink, but not for the actual amount of residual ink in the ink cartridge, there is a possibility that the initial filling may not be completed successfully.

SUMMARY

The present invention has been made to solve at least a part of the problems described above, and may be realized as the following forms or application examples.

Application Example 1

According to an aspect of the invention, there is provided a printing apparatus including a head that discharges ink; a mounting unit on which a cartridge having a storage unit that stores information on the amount of ink in the cartridge consumed with ink discharge from the head is mounted; a detection unit that detects a state of the amount of residual ink in the cartridge; and a control unit that controls initial filling of the head, the control unit performs the operation of initial filling when the amount of residual ink detected by the detection unit is equal to or more than a predetermined amount, and the amount of residual ink based on the information on the amount of ink stored in the storage unit is equal to or more than a predetermined value.

According to the printing apparatus described above, the control unit performs the initial filling when the amount of residual ink detected by the detection unit is equal to or more than the predetermined amount, and the amount of residual ink based on the information on the amount of ink in the cartridge is equal to or more than the predetermined value. Therefore, even in a case where the calculated amount of residual ink is equal to or more than the predetermined value, if the actual amount of residual ink in a cartridge is smaller than the predetermined amount, the initial filling may not be performed. In this way, in a case where the actual amount of residual ink does not satisfy a condition in which initial filling process is performed, the initial filling process may be prevented from being performed.

Application Example 2

In the printing apparatus, the predetermined value may be obtained by adding the amount of ink used in the initial filling and the amount of ink consumable after the detection unit detects that the residual amount of ink in the cartridge is less than the predetermined amount.

According to the printing apparatus described above, the predetermined value is obtained by adding the amount of ink used in the initial filling and the amount of ink consumable after the detection unit detects that the residual amount of ink in the cartridge is less than the predetermined amount. In this way, while the initial filling is performed, the actual amount of residual ink in the cartridge may be prevented from becoming less than the predetermined amount.

Application Example 3

In the printing apparatus, the predetermined value may vary in accordance with types of cartridge and types of ink accommodated in the cartridge.

According to the printing apparatus described above, the predetermined value varies depending on the type of cartridge and type of ink. In this way, the predetermined value may be properly defined depending on the type such as purpose or capacity of the cartridge, and the type such as a color or, a dye-base or a pigment-base of ink.

BRIEF DESCRIPTION OF THE DRAWINGS

FIG. 4 is a diagram illustrating a configuration example of cartridge information stored in a storage unit of an ink cartridge.

FIG. 5 is a diagram illustrating a configuration example of initial filling information stored in a storage unit of a printing apparatus.

FIG. 6 is an example of the effective amount of ink (g) defined by an ink cartridge type and an ink type.

DESCRIPTION OF EXEMPLARY EMBODIMENTS

First Embodiment

Hereinafter, the printing apparatus according to the first embodiment will be described with reference to the accompanying drawings.

Figure 1:
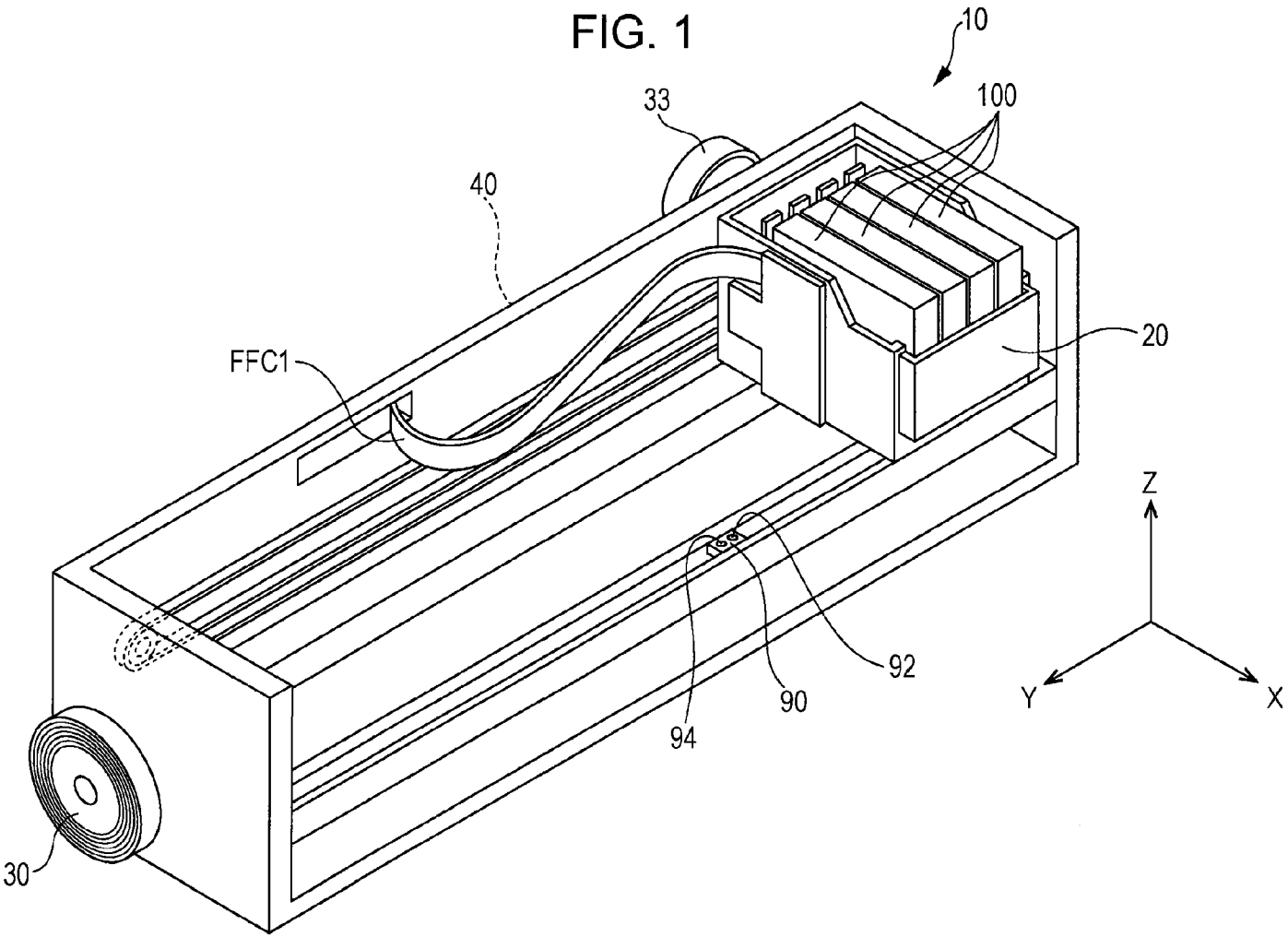
FIG. 1 is a perspective view illustrating a main part of a printing apparatus.
Figure 2:
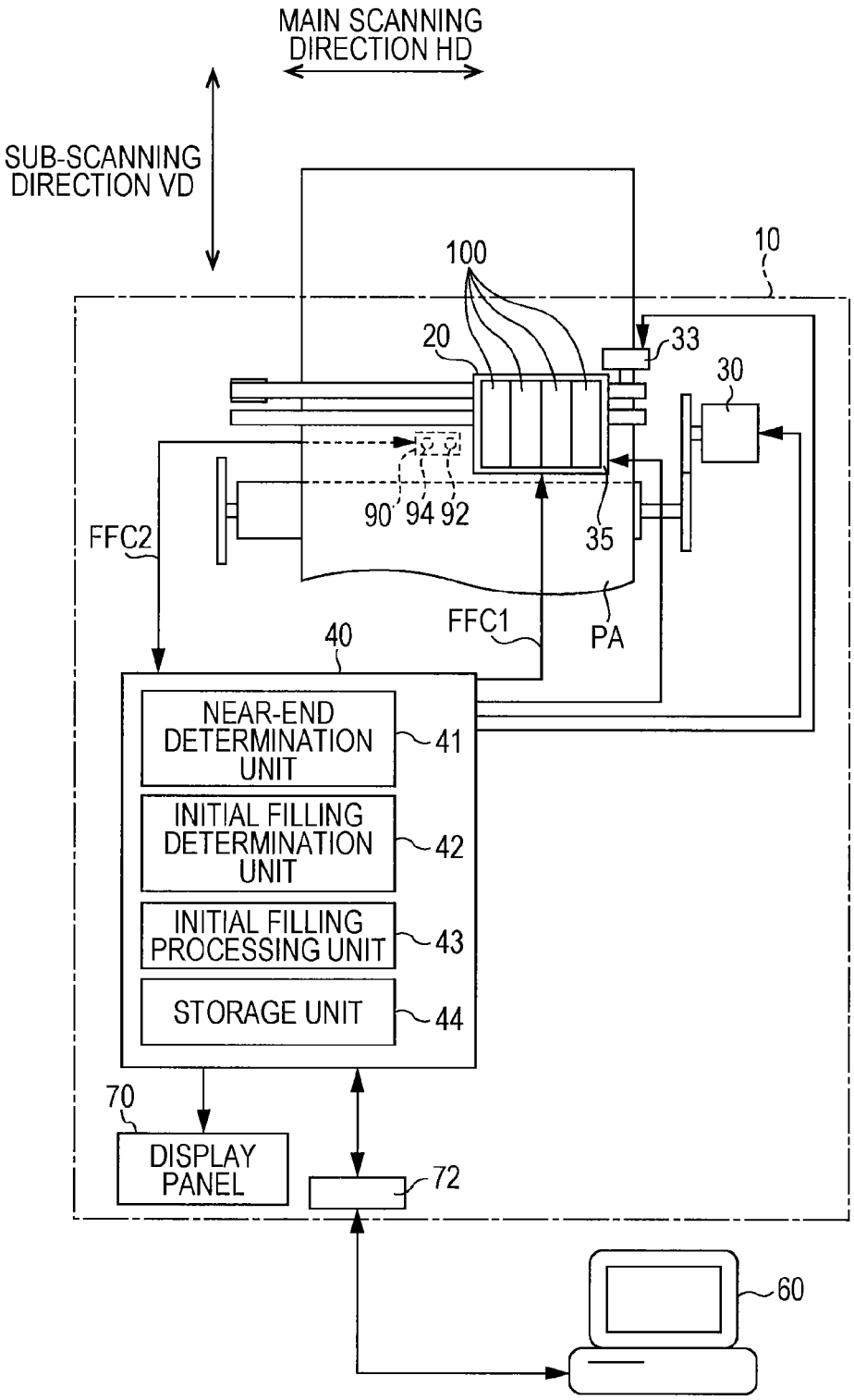
FIG. 2 is a schematic configuration diagram of a printing apparatus.

FIG. 1 is a perspective view illustrating a main part of a printing apparatus 10. FIG. 2 is a schematic configuration diagram of a printing apparatus 10. In FIG. 1, XYZ axes orthogonal to each other are drawn, and following drawings are also denoted by XYZ axes as necessary. In this embodiment, using the position of the printing apparatus 10, a Z axis direction (Z direction and −Z direction) is a vertical direction and the surface of an X direction of the printing apparatus is a front surface. Further, a main scanning direction of the printing apparatus 10 is a Y axis direction (Y direction and −Y direction) and a sub-scanning direction is an X axis direction (X direction and −X direction).

The printing apparatus 10 is configured of a plurality of ink cartridges 100, a holder 20 as a mounting unit, a paper feeding motor 30, a carriage motor 33, a printing head 35, a detection unit 90, and a control unit 40 as a control unit. Colors of ink such as cyan, magenta, yellow, and black are accommodated in each ink cartridge 100 one by one. Each ink cartridge 100 is mounted on the holder 20. As the holder 20, it is possible to use a holder capable of mounting plural types of arbitrary ink cartridges other than the types described above. The holder 20 and the printing head 35 are provided in a carriage, and reciprocate over a print medium PA by being driven by the carriage motor 33. The paper feeding motor 30 transports the print medium PA to a sub-scanning direction VD. The carriage motor 33 drives the holder 20 to a main scanning direction HD. The printing head 35 is mounted on a carriage and discharges ink supplied from each ink cartridge 100. In FIGS. 1 and 2, the holder 20 is located in a home position. Furthermore, it has been described the examples in which the present invention is applied to a printing apparatus of on-carriage type in which the holder 20 is placed on the carriage. However, the present invention is also applicable to a printing apparatus of off-carriage type in which the holder 20 is placed outside the carriage.

The detection unit 90 is arranged in parallel with the main scanning direction HD of the holder 20 and detects a state of an amount of residual ink. The detection unit 90 that is configured as a reflective type photo interrupter (photo reflector) of includes a light emitting unit 92, a light receiving unit 94 that is configured of photo diodes and a detection circuit that outputs a voltage in response to a change of current flowing between a light receiving unit and a power potential. The light emitting unit 92 and the light receiving unit 94 provided in the detection unit 90 are arranged parallel alongside the main scanning direction HD (Y axis direction) in which the holder 20 moves.

The control unit 40 is configured to function as a near-end determination unit 41, an initial filling determination unit 42, an initial filling process unit 43, a storage unit 44, and an ink consumption estimation unit (not shown). Further, the control unit 40 includes CPU, ROM, RAM and the like (not shown). The CPU functions as the near-end determination unit 41, the initial filling determination unit 42, the initial filling process unit 43 and the ink consumption estimation unit by loading a control program which has been previously stored in ROM into RAM and causing the control program to be executed. Alternatively, the near-end determination unit 41, the initial filling determination unit 42, the initial filling process unit 43 and the ink consumption estimation unit may be configured of dedicated control ICs that perform these functions. Further, a portion may be configured of a control program that is stored in ROM, and CPU, the remaining portion may be configured of dedicated control ICs. The control unit 40 controls a printing with respect to a printing medium PA by controlling the paper feeding motor 30, the carriage motor 33, or the printing head 35.

A display panel 70 in which the operation state, the error message or the like of the printing apparatus 10 is displayed is connected to the control unit 40. Further, in the control unit 40, a computer 60 is connected through an interface 72. Further, in the control unit 40, the carriage is connected through cable FFC 1, and the detection unit 90 is connected through cable FFC 2.

The near-end determination unit 41 determines whether or not the amount of residual ink in the ink cartridge 100 is less than a predetermined amount (first predetermined value) using a prism 170 (refer to FIG. 3) arranged in the ink cartridge 100. When the amount of residual ink is less than the predetermined amount, it will be also referred to as "ink near-end" from now on. When the prism 170 of the ink cartridge 100 is placed in a predetermined position (detection position) with respect to the detection unit 90, the near-end determination unit 41 obtains an output voltage in which the detection circuit of the detection unit 90 that depends on the amount of light received by the light receiving unit outputs, through the cable FFC 2 from the detection unit 90. Then, the near-end determination unit 41 determines whether or not the amount of residual ink in the ink cartridge 100 is less than the predetermined amount based on the obtained output voltage and a predetermined threshold value.

The initial filling determination unit 42 determines whether or not an initial filling process is performed on the basis of information regarding whether or not an initial filling process in the printing apparatus 10 is completed, the amount of residual ink in each ink cartridge 100 and the like. The initial filling process unit 43 performs an initial filling process in which ink is supplied to the printing head 35 from each ink cartridge 100 for the first time. The storage unit 44 stores information regarding whether or not the initial filling process is completed or the like. For example, a non-volatile memory such as EEPROM can be used as the storage unit 44.

Figure 3:
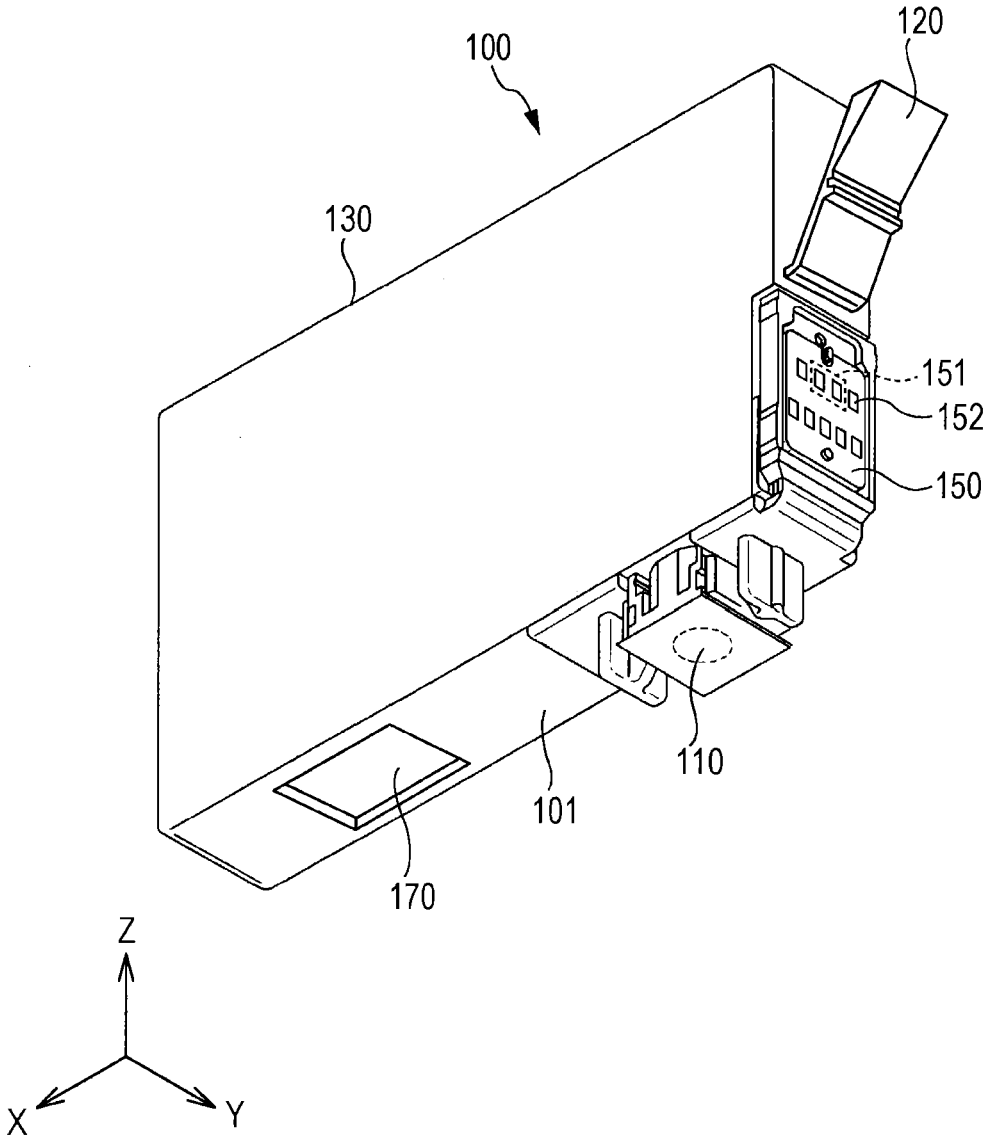
FIG. 3 is a perspective view of an ink cartridge.

FIG. 3 is a perspective view of the ink cartridge 100. The ink cartridge 100 includes an ink accommodation chamber 130 having an approximately rectangular shape that accommodates ink inside, a circuit substrate 150, and a lever 120 for which the ink cartridge 100 is installed or removed with respect to the holder 20. The circuit substrate 150 is provided on the surface of −X direction side toward the −Z direction side in the ink accommodation chamber 130, and the lever 120 is provided on the surface of −X direction side toward the +Z direction side in the ink accommodation chamber 130. The prism 170 in the shape of a right angle isosceles triangular pole is arranged in a bottom portion of the ink accommodation chamber 130. A bottom surface of the prism 170 is exposed from a bottom surface 101 that forms a surface of −Z direction side in the ink cartridge 100. When the ink cartridge 100 is mounted on the holder 20, an ink supply port 110, in which an ink supply needle (not shown) provided in the holder 20 is inserted, is formed on the bottom surface 101 of the ink cartridge 100. When the ink cartridge 100 is prior to use, the ink supply port 110 is sealed off by a film. When the ink cartridge 100 is mounted in the holder 20 from upside, the film is broken by the ink supply needle, and then ink is supplied to the printing head 35 from the ink accommodation chamber 130 through the ink supply port 110.

A storage unit 151 for storing information regarding the ink cartridge 100 is stored is mounted on the reverse side of the circuit substrate 150. A plurality of terminals 152 which are electrically connected to the storage unit 151 is arranged on the surface of the circuit substrate 150. When the ink cartridge 100 is mounted on the holder 20, the plurality of terminals 152 are in electrical contact with a plurality of body side terminals (not shown) provided in the holder 20. These body side terminals are electrically connected to a control unit 40 through the cable FFC 1. In this way, when the ink cartridge 100 is mounted on the holder 20, it is possible for the control unit 40 to read and write data with respect to the storage unit 151 by being electrically connected to the storage unit 151. For example, the non-volatile memory such as EEPROM can be used as the storage unit 151. Such an ink cartridge configuration is an example, so that an ink cartridge having other arbitrary configuration can be further applied.

FIG. 4 is a diagram illustrating a configuration example of cartridge information C10 stored in a storage unit 151 of the ink cartridge 100. As shown in FIG. 4, the cartridge information C10 of the ink cartridge 100 includes ink consumption (%) C11, ink cartridge type C12, ink type C13, and ink cartridge ID C14. The ink consumption (%) C1 indicates a ratio of amount of ink consumed with respect to an effective amount of ink. The effective amount of ink indicates the amount of ink capable of being consumed by the print apparatus out of the amount of ink accommodated in an ink accommodation chamber 130 of an ink cartridge 100 at the time of shipment. (In the ink cartridge, in order to prevent blank firing of a head, an ink consumption estimation unit of a body is set up such that a small amount of ink remains in the cartridge when the total ink consumption in the ink cartridge becomes 100%. The amount of ink capable of being consumed by the print apparatus corresponds to the amount in which the total ink consumption is counted to be 100% by the ink consumption estimation unit.) The ink cartridge type C12 indicates a type of the ink cartridge 100. The ink type C13 indicates a type of ink accommodated in the ink cartridge 100. The ink cartridge ID C14 is identification information capable of specifying the ink cartridge 100 individually, for example, manufacturing information is used in which a manufacturing line, a manufacturing day, a manufacturing hour, a manufacturing minute and a manufacturing second can be specified.

FIG. 5 is a diagram illustrating a configuration example of initial filling information P10 stored in a storage unit 44 of the printing apparatus 10. As shown in FIG. 5, the initial filling information P10 of the printing apparatus 10 includes an initial filling flag P11. As an initial value, "0" is set in the initial filling flag P11. In a case where the initial filling process is completed in the printing apparatus 10, "1" is set.

FIG. 6 shows an example of a table of the effective amount of ink (g) defined by the ink cartridge type C12 and the ink type C13 shown in FIG. 4. Such information is stored in the storage unit 44 of the printing apparatus 10. An ink consumption estimation unit obtains the effective amount of ink accommodated in the ink cartridge from the table depending on type of ink cartridge and type of ink that have been read out from the storage unit 151 of the cartridge. Then, an ink consumption rate is calculated from the total ink consumption discharged from a head with respect to the effective amount of ink. Therefore, the ink consumption estimation unit updates the ink consumption (%) C11 of the storage unit 151 with appropriately calculated ink consumption ratio. The timing for an update is when a print JOB is completed, a predetermined amount of ink is consumed, the printing apparatus is powered off and the like. In FIG. 6, four types of ink cartridge, which are "bundle", "L size", "M size", "S size", are shown as an ink cartridge type. The "bundle" is a cartridge supplied with when the printing apparatus 10 is shipped. The ink cartridges of "L size", "M size" and "S size" accommodate different amounts of ink from each other since users of the printing apparatus can purchase the ink cartridges separately from the printing apparatus. The users select the ink cartridge size depending on printing frequencies or the like. The amount of ink for "L size", "M size" and "S size" is, respectively, an L size cartridge, an M size cartridge and an S size cartridge. Further, as the types of ink, the four colors of ink, which are "black", "cyan", "magenta", and "yellow", are shown. The effective amount of ink (g) that is formed in combination with each type of ink cartridge and each type of ink is shown in a tabular form. An amount of ink that is equal to or more than the amount of ink in which the initial filling process can be performed is accommodated in the bundle cartridge.

Subsequently, a determination method of an ink near-end using the prism 170 will be described.

Figure 7:
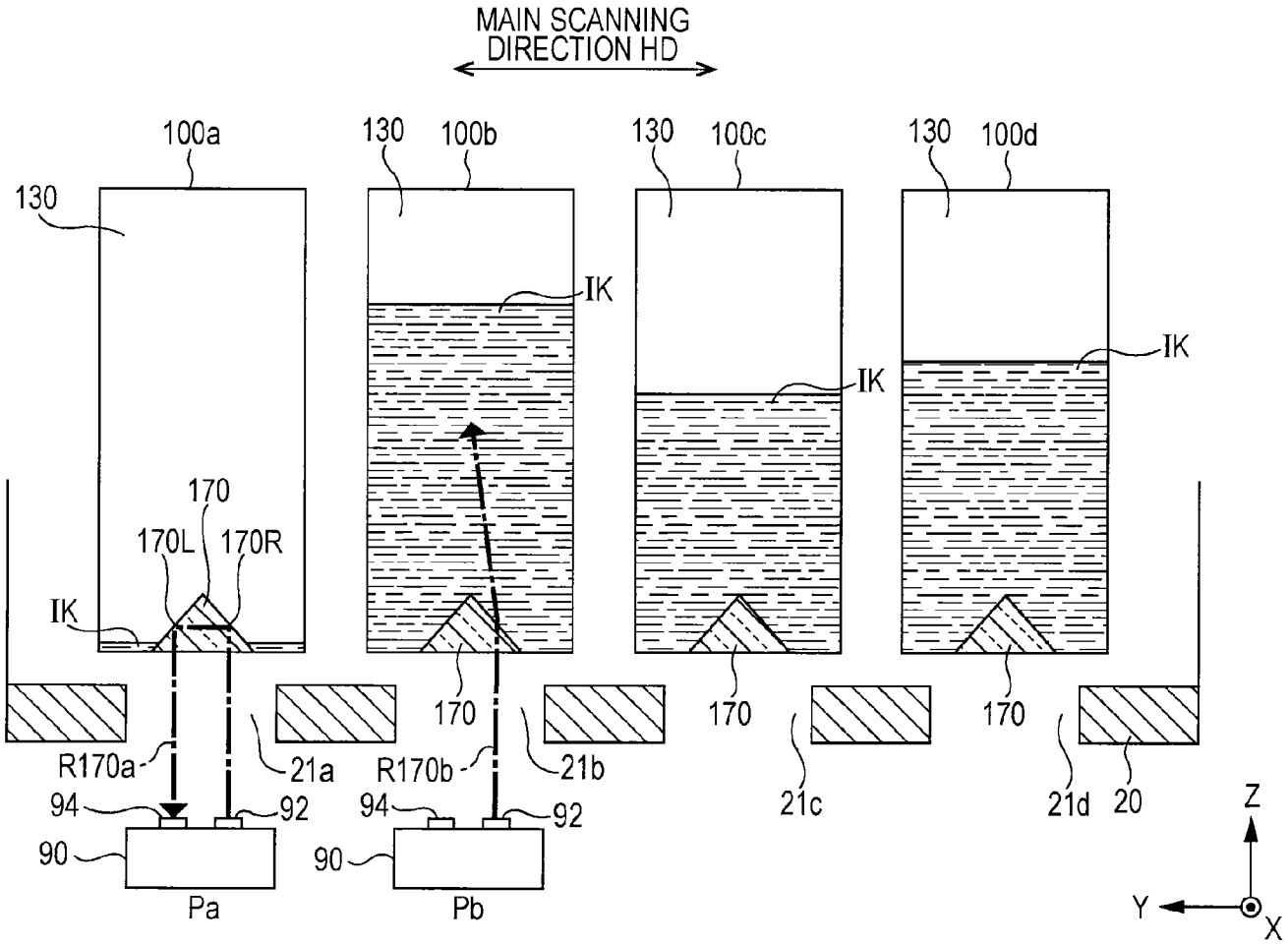
FIG. 7 is a diagram for describing a prism used in the determination of an ink near-end.

FIG. 7 is a diagram for describing the prism 170 used in determining an ink near-end. As shown in FIG. 7, four openings of 21*a* to 21*d* are provided on the bottom surface of the holder 20 of the printing apparatus 10. In the holder 20, in the corresponding positions to the openings 21*a* to 21*d*, four ink cartridge 100*a* to 100*d* having the colors of cyan, magenta, yellow, and black are respectively mounted. Each prism 170 provided in each ink accommodation chamber 130 of the ink cartridge 100*a* to 100*d* is a transparent member having a shape of a right angle isosceles triangular pole shape, for example, made of polypropylene forming an apex angle with tilted surfaces 170L and 170R. The state of reflected light of light incident on the prism 170 from a light emitting unit 92 varies in accordance with a refractive index of fluid (ink or air) that contacts each of tilted surfaces 170L and 170R.

The holder 20 is driven by the aforementioned carriage motor 33, thereby reciprocating over the detection unit 90 that is fixed on the printing apparatus 10 in the main scanning direction HD. When the holder 20 moves over the detection unit 90, the positional relationship between the holder 20 and the detection unit 90 relatively changes as an example of a position Pa and a position Pb shown in FIG. 7.

In the position Pa, the prism 170 of ink cartridge 100*a* which are in the state of "ink near-end" and the detection unit 90 face each other. In the ink cartridge 100*a*, most of the tilted surfaces 170L and 170R of the prism 170 in which ink IK is consumed are exposed from the ink IK and the tilted surfaces 170L and 170R are in contact with air. Therefore, when light R 170*a* irradiated toward the prism 170 from the light emitting unit 92 is incident on the prism 170 from the bottom surface of the prism 170, each tilted surface 170R and 170L is totally reflected due to the refractive index of the prism 170 and the air. Accordingly, the reflected light of the light 170*a* irradiated from the light emitting unit 92 has a travelling direction thereof reversed by 180 degrees, and is emitted outside from the bottom surface of the prism 170 to cause the light receiving unit 94 to receive the light.

The ink cartridge 100*b* is in the state of "ink filled". In the position Pb, the detection unit 90 faces prism 170 of the ink cartridge 100*b*. In the ink cartridge 100*b*, the ink IK remains to the higher position than the tilted surfaces 170L and 170R of the prism 170. Therefore, since the refracting index of the prism 170 and the ink IK are in the same range, most of the light R170*b* that is irradiated toward the prism 170 from the light emitting unit 92 passes through the tilted surface 170R, and then is absorbed in the ink IK.

The control unit 40 moves the holder 20 in the main scanning direction HD as if respective prism 170 of ink cartridges 100*a* to 100*d* passes over the detection unit 90. Subsequently, the control unit 40 obtains an output voltage corresponding to light amount of reflected light from each prism 170 by the detection unit 90. The near-end determination unit 41 determines whether each of the ink cartridges 100*a* to 100*d* is in the state of "ink filled" or "ink near-end" based on each measurement result. After the "ink near-end" is detected, if the amount of ink previously set is consumed, the control unit 40 determines that the cartridge is out of ink, thereby stopping the operation of the printing apparatus.

Subsequently, a determination process when an initial filling process is performed will be described.

Figure 8:
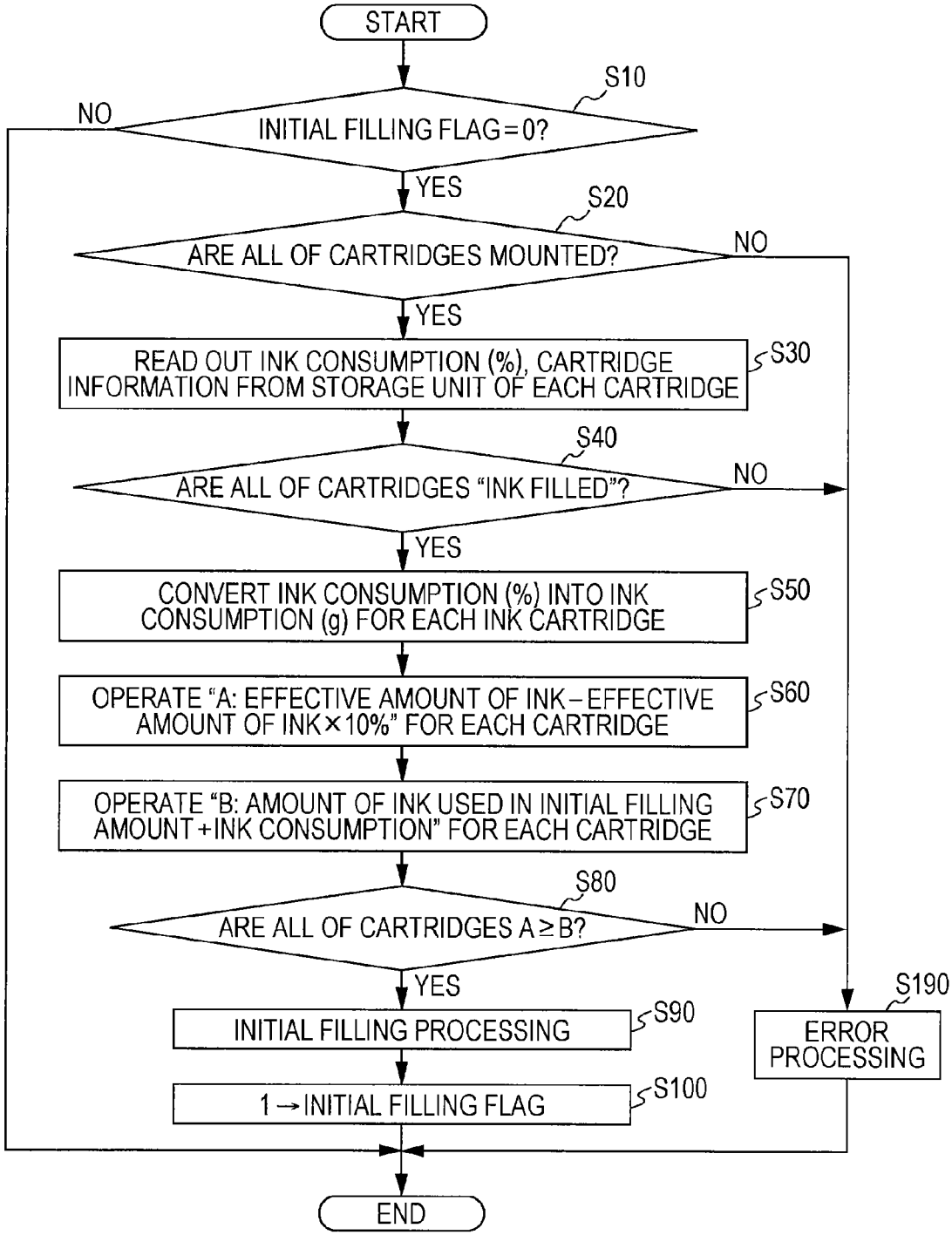
FIG. 8 is a flowchart related to a determination processing when an initial filling process is performed.

FIG. 8 is a flowchart related to a determination processing when the initial filling process is performed. The determination process, for example, is performed at a time such as when the printing apparatus 10 starts up, or when the holder 20 is mounted with the ink cartridge 100.

First of all, the control unit 40 determines whether or not the initial filling flag P11 stored in the storage unit 44 of the printing apparatus 10 is "0", that is, determines whether or not the initial filling process is incomplete with respect to the printing apparatus 10 (step S10).

When the initial filling flag P11 is "0' (initial filling process is not complete) (step S10: YES), such a case proceeds to following step S20. On the other hand, when the initial filling flag P11 is not "0" (initial filling process is completed) (step S10: NO), such a case ends the processing of the flowchart.

In step S20, the control unit 40 determines whether or not all of the ink cartridges 100 are mounted in the holder 20.

When all of the ink cartridge 100 are mounted (step S20: YES), such a case proceeds to following step S30. On the other hand, when any of each ink cartridge 100 are not mounted (step S20: NO), such a case proceeds to step S190, displays an error message indicating that the ink cartridge is not mounted on a display panel 70, and then ends the processing of the flowchart.

In step S30, the control unit 40 reads out ink consumption (%) C11, an ink cartridge type C12, an ink type C13, and an ink cartridge ID C14 from ink cartridge information C10 that is stored in the storage unit 151 of each ink cartridge 100, and then stores those in the RAM of the control unit 40.

Subsequently, the control unit 40 detects the remaining state of the ink for each ink cartridge 100 using the prism 170 and determines whether or not all of the ink cartridges 100 are in the state of "ink filled" (step S40).

When all of the ink cartridge 100 are in the state of "ink filled" (step 40: YES), such a case proceeds to following step S50. On the other hand, when any of each ink cartridge 100 is in "near-end" state (step S40: NO), such a case proceeds to step S190, displays an error message indicating that the ink cartridge is in the state of "ink near-end" on the display panel 70, and then ends the processing of the flowchart.

In step S50, the control unit 40 converts the ink consumption (%) which has been read out in the step S30 into the ink consumption (g) showing ink weight for each ink cartridge 100. (referring to the table of FIG. 6, obtain ink consumption (g) from effective ink consumption.) Subsequently, the control unit 40 operates "A: effective amount of ink−effective amount of ink×10%" for each ink cartridge 100 (step S60).

Here, the operation result A represents the ink consumption when each ink cartridge 100 reaches the state of "ink near-end". That is, when the detection unit 90 gives an ink near-end determination, the printing apparatus is designed in such a manner that the ink consumption becomes 90%, and becomes the state of "ink near-end" when 90% of the effective amount of ink is consumed. Further, the effective amount of ink×10% represents the ink consumption capable of executing the remaining print continuously in the printing apparatus 10 after becoming "ink near-end" state. (after ""ink near-end" described above is detected", corresponding to "amount previously set") For example, in the example of FIG. 6, when the ink cartridge type "bundle" has the ink type "black", the effective amount of ink is 12 g, and when the ink cartridge is in the state of "ink near-end", the ink consumption is approximately 10.8 g. Furthermore, the ink consumption when the ink cartridge is in the state of "ink near-end", the ink consumption, for example, can be set properly according to usage environment, purpose or the like without being limited to 90% of effective amount of ink.

Subsequently, in each ink cartridge 100, the control unit 40 operates "B: amount of ink used in initial filling (referred to as "amount of ink for initial filling")+ink consumption" (step S70). Here, the amount of initial filling ink in each ink cartridge 100 becomes the amount of ink used to fill the gap to the printing head 35 with ink. The ink consumption is the ink consumption (g) after conversion in step 50 for each ink cartridge 100.

Subsequently, the control unit 40 determines whether or not operation result A operation result B for all of ink cartridge 100 (step S80).

Here, the comparison expression of operation result A operation result B represents "effective amount of ink−effective amount of ink×10%"≥"initial filling amount of ink+ink consumption" as described above. In a case where "amount of residual ink calculated on the basis of ink consumption (referred to as "calculated amount of residual ink")=effective amount of ink-ink consumption", the comparison expression described above can be converted into the comparison expression which is "calculated amount of residual ink"≥"initial filling amount of ink+effective amount of ink×10%". Furthermore, "initial filling amount of ink+effective amount of ink×10%" corresponds to the predetermined value.

In a case where operation result A operation result B, that is, "calculated amount of residual ink"≥"initial filling amount of ink+effective amount of ink×10%" (step S80: YES), it is determined that the initial filling can be performed, then the process proceeds to following step S90. On the other hand, in a case where the operation result A<operation result B, that is, in a case where "calculated amount of residual ink"<"initial filling amount of ink+effective amount of ink×10%" (step S80: NO), it is determined that the initial filling cannot be performed. Then, the process proceeds to step S190, displays an error message indicating that "the initial filling not allowed" on the display panel 70, and then ends the processing of the flowchart.

For example, in FIG. 6, the initial filling amount of ink becomes 2 g which is common to a type of each ink cartridge. In a case where each ink cartridge 100 of "black", "cyan", "magenta" and "yellow" of "M size" in an unused state is mounted, an effective amount of ink is respectively "8 g", "7 g", "7 g", and "7 g" as shown in FIG. 6. Since each effective amount of ink is in the unused state, the effective amount of ink and the calculated amount of residual ink are equal. Therefore, the comparison result of "calculated amount of residual ink"≥"initial filling amount of ink+effective amount of ink×10%" is "8 g">"2 g+0.8 g" for "black", and is "7 g">"2 g+0.7 g" also for "cyan", "magenta" and "yellow" such that the initial filling process can be performed.

On the other hand, in a case where each ink cartridge 100 of "black", "cyan", "magenta" and "yellow" of "S size" in an unused state is mounted, effective amount of ink is respectively "5 g", "1 g", "1 g", and "1 g" as shown in FIG. 6. Since each effective amount of ink is in the unused state, the effective amount of ink and the calculated amount of residual ink are equal. Therefore, the comparison result of "calculated amount of residual ink" "amount of ink for initial filling+effective amount of ink×10%" is "5 g">"2 g+0.5 g" for "black", and is "1 g"<"2 g+0.1 g" for "cyan", "magenta" and "yellow" such that the initial filling process cannot be performed.

In step S90, the control unit 40 performs the initial filling process to fill the gap to the printing head 35 with ink from each ink cartridge 100. Then, "1" indicating the initial filling is completed is set to the initial filling flag P11 of the printing apparatus 10 (step S100), and the processing of the flowchart ends.

In the embodiment described above, whether each ink cartridge is in the state of "ink filled" or "ink near-end" is detected using each prism. Then, even in a case where the calculated amount of residual ink of all the ink cartridges meets the condition to perform the initial filling process, the initial filling process is not performed when the ink cartridge is in the state of "ink near-end". In this way, for example, even in such a case where the ink cartridge is used in which the amount of residual ink has decreased by lapse of time due to reasons such as drying of ink, or information related to ink consumption is not stored correctly in the storage unit of the ink cartridge, it is possible to cope with the cases. Specifically, although the calculated amount of residual ink of the ink cartridge meets the condition to perform the initial filling process, in a case where the amount of residual ink in the ink cartridge is actually small, a problem possibly occurs, in which the initial filling process is not correctly performed because the amount of ink required for initial filling results in a shortage, however such a problem can be suppressed from occurring.

Second Embodiment

Hereinafter, the printing apparatus according to a second embodiment will be described with reference to drawings.

Although the printing apparatus according to the second embodiment is configured to be approximately the same as the printing apparatus 10 according to the first embodiment, a difference exists between the configuration of the initial filling information P10 stored in the storage unit 44 of the printing apparatus 10 and the flowchart related to the determination processing when the initial filling process is performed. Furthermore, hereinafter, with respect to the configuration and processing contents which are the same as the first embodiment, the same reference numerals are given, and the detailed description thereof is omitted.

Figure 9:
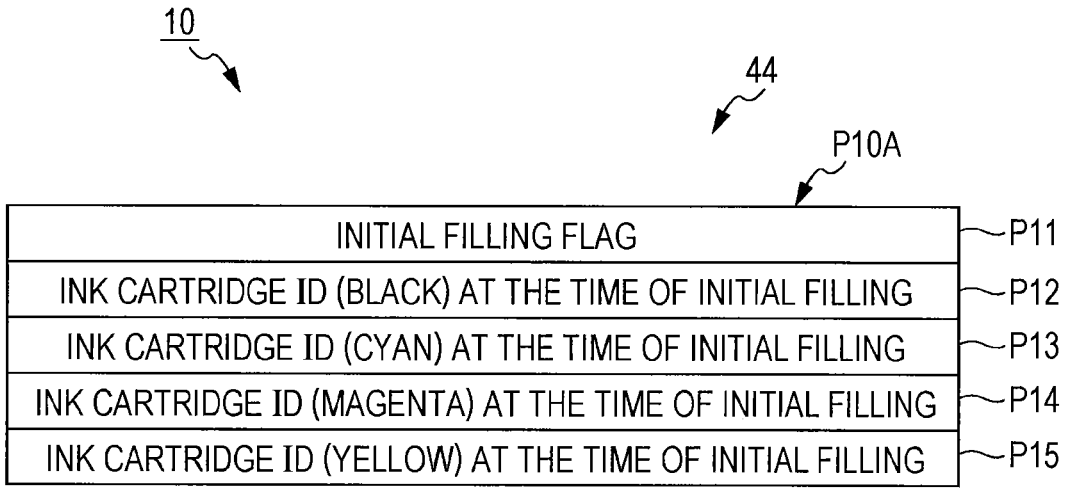
FIG. 9 is a diagram illustrating a configuration example of initial filling information for a printing apparatus according to a second embodiment.

FIG. 9 is a diagram illustrating a configuration example of initial filling information P10A for the printing apparatus 10 according to the second embodiment. As shown in FIG. 9, the initial filling information P10A of the printing apparatus 10 is added to the initial filling flag P11, and stores ink cartridge ID supplied the ink for the initial filling at the time of the initial filling.

Specifically, the ink cartridge ID includes an ink cartridge ID (black) P12 at the time of initial filling, an ink cartridge ID (cyan) P13 at the time of initial filling, an ink cartridge ID (magenta) P14 at the time of initial filling, and an ink cartridge ID (yellow) P15 at the time of initial filling.

Figure 10:
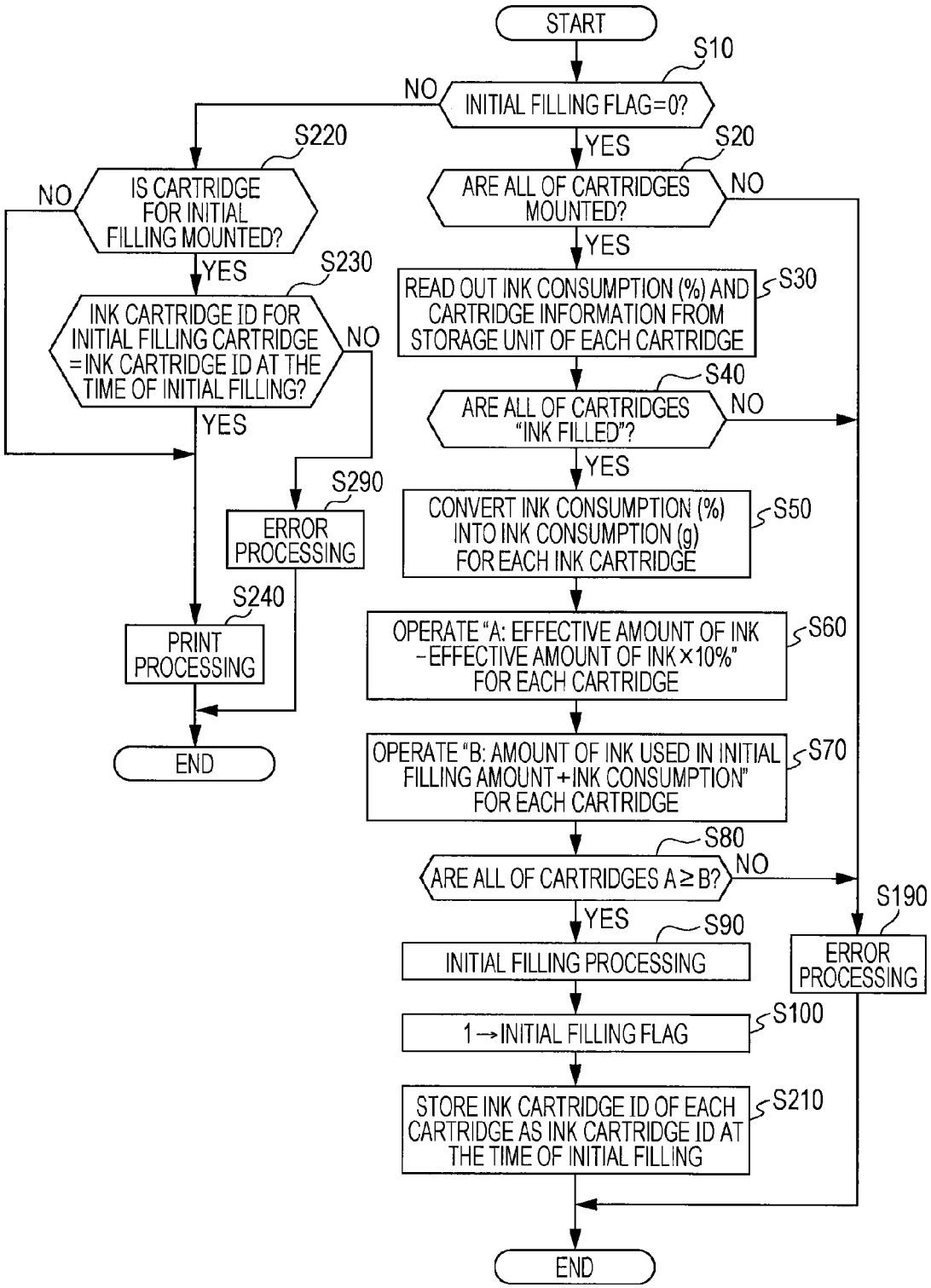
FIG. 10 is a flowchart related to a determination processing when an initial filling process is performed according to the second embodiment.

FIG. 10 is a flowchart related to a determination process when an initial filling process is performed according to the second embodiment. With respect to the flowchart according to the first embodiment as shown in FIG. 8, the process of steps S2210 to S290 is added in the flowchart shown in FIG. 10. Since the processing contents of steps S10 to S190 are the same as the processing contents of steps S10 to S190 of the flowchart according to the first embodiment shown in FIG. 8, the description thereof is omitted.

The step S210 of the flowchart shown in FIG. 10 is a process in which the printing apparatus is executed after the initial filling process is performed (step S90), and "1" indicating that the initial filling is completed is set to the initial filling flag P11 (step S100). Accordingly, the step S210 is a processing executed after S100 of FIG. 8 is passed through, or the initial filling flag "1" is set in the step S10 at the time of start-up of the printing apparatus. In step S210, the control unit 40 stores each of ink cartridge IDs C14 of each ink cartridge 100 which has been read out in step S30 as the ink cartridges IDs (black to yellow) P12 to P15 of the initial filling information P10A of the printing apparatus 10. Then, the processing of the flowchart ends.

Further, in step S10, in a case where the initial filling flag P11 is not "0" (initial filling process is completed) (step S10: NO), the step S220 performs a processing. Furthermore, at this point, cartridge information C10 of each ink cartridge 100 is loaded into the RAM. In step S220, the control unit 40 determines whether or not the ink cartridge 100 for the initial filling is mounted in the holder 20 based on ink cartridge type C12 loaded in the RAM. When ink cartridge 100 for the initial filling is mounted (step S220: YES), such a case proceeds to following step S230. On the other hand, when even one of ink cartridge 100 for the initial filling is not mounted (step S220: NO), such a case proceeds to step S240, and then ends the processing of the flowchart by performing a print process.

In step S230, the control unit 40 determines whether or not ink cartridge ID C14 loaded in the RAM and corresponding ink cartridge IDs (black to yellow) P12 to P15 at the time of initial filling in the printing apparatus 10 correspond to the ink cartridge 100 for initial filling that are mounted.

When the ink cartridge ID C14 and the corresponding ink cartridge IDs (black to yellow) P12 to P15 at the time of initial filling correspond with respect to all of the ink cartridge 100 for initial filling (step S230: YES), such a case proceeds to following step S240, and ends the processing of the flowchart by performing print process. On the other hand, when the ink cartridge ID C14 and the corresponding ink cartridge IDs (black to yellow) P12 to P15 do not correspond to any of the ink cartridge 100 for initial filling (step S230: NO), such a case proceeds to step S290, displays an error message indicating that an ink cartridge is different from the ink cartridge at the time of initial filling on the display panel 70, and then ends the processing of the flowchart.

In the embodiment described above, when an initial filling process is performed, the ink cartridge ID of each ink cartridge is stored in the storage unit of the printing apparatus. Then, after the initial filling process is performed, in a case where the ink cartridge for initial filling is mounted, the ink cartridge ID stored in the printing apparatus and the ink cartridge ID of the ink cartridges for initial filling are compared to each other, and in a case where they do not correspond to each other, an error occurs. Since a situation in which an additional bundle of cartridge is purchased by users in addition to the cartridge which comes with does not occur, usually, an irregular situation is assumed. In such a case, a possibility that a problem occurs in the printing apparatus can be suppressed by considering the ink cartridge as having an error.

Modification Example 1

In the embodiment described above, the state of remaining amount of ink of ink cartridge is detected using a prism arranged in the ink cartridge and a detection unit having a light emitting unit and a light receiving unit. However, without being limited to this configuration, for example, a configuration may be implemented by arranging an sensor for residual ink amount such as a pressure sensor in the ink cartridge.

Modification Example 2

In the embodiment of the present invention described above, examples applied to the printing apparatus and the ink cartridge are described. However, the present invention may be used in a liquid consumption apparatus in which a liquid other than ink is injected or discharged, and may also be applicable to a liquid container accommodating such a liquid. Further, the liquid container according to the present invention may be diverted into various types of liquid consumption apparatus provided with a liquid injection head or the like discharging a small amount of droplet.

Modification Example 3

In the embodiment described above, the table of FIG. 6 stored in the control unit 40 is referred to according to the ink cartridge type and the ink type stored in the storage unit 151 of the ink cartridge, thereby determining the effective amount of ink of each cartridge. However, the effective amount of ink may be stored in the storage unit 151 of cartridge.

Modification Example 4

In the embodiment described above, the printing apparatus of on-carriage is provided over the carriage in which the ink cartridge is provided with a head. However, the printing apparatus may be provided in a different place without being provided over the carriage in which the ink cartridge is provided with the head.

What is claimed is:

1. A printing apparatus comprising:

a head that discharges ink;

a mounting unit on which a cartridge having a storage unit that stores information on the amount of ink in the cartridge consumed with ink discharge from the head is mounted;

a detection unit that detects a state of the amount of residual ink in the cartridge; and a control unit that controls initial filling of the head, wherein the control unit performs the initial filling when the amount of residual ink detected by the detection unit is equal to or more than a predetermined amount, and the amount of residual ink based on the information on the amount of ink stored in the storage unit is equal to or more than a predetermined value.

2. The printing apparatus according to claim 1, wherein the predetermined value is obtained by adding the amount of ink used in the initial filling and the amount of ink consumable after detection unit detects that the amount of residual ink is less than the predetermined amount.

3. The printing apparatus according to claim 1, wherein the predetermined value varies depending on the type of cartridge and type of ink accommodated in the cartridge.

* * * * *